US008011892B2

(12) United States Patent
Ramlogan et al.

(10) Patent No.: US 8,011,892 B2
(45) Date of Patent: Sep. 6, 2011

(54) TURBINE BLADE NESTED SEAL AND DAMPER ASSEMBLY

(75) Inventors: Amarnath Ramlogan, Glastonbury, CT (US); Rajendra K. Agrawal, South Windsor, CT (US); Stephen D. Doll, Portland, CT (US)

(73) Assignee: United Technologies Corporation, Hartford, CT (US)

( * ) Notice: Subject to any disclaimer, the term of this patent is extended or adjusted under 35 U.S.C. 154(b) by 1104 days.

(21) Appl. No.: 11/769,756

(22) Filed: Jun. 28, 2007

(65) Prior Publication Data

US 2009/0004013 A1 Jan. 1, 2009

(51) Int. Cl.
*F01D 5/26* (2006.01)
*F01D 25/04* (2006.01)

(52) U.S. Cl. ..... 416/190; 416/193 A

(58) Field of Classification Search ..... 416/190, 416/193 A, 219 R, 221, 500
See application file for complete search history.

(56) References Cited

U.S. PATENT DOCUMENTS

| | | | |
|---|---|---|---|
| 2,633,776 | A | 4/1953 | Schenk |
| 2,962,941 | A | 12/1960 | Stein et al. |
| 5,228,835 | A | 7/1993 | Chlus |
| 5,277,548 | A | 1/1994 | Klein et al. |
| 5,281,099 | A | 1/1994 | Hunter et al. |
| 5,340,278 | A | 8/1994 | Magowan |
| 5,382,135 | A | 1/1995 | Green |
| 5,415,526 | A | 5/1995 | Mercadante et al. |
| 5,556,257 | A | 9/1996 | Foster et al. |
| 5,573,375 | A | 11/1996 | Barcza |
| 5,785,499 | A | 7/1998 | Houston et al. |
| 5,924,699 | A | 7/1999 | Airey et al. |
| 6,145,300 | A | 11/2000 | Romani |
| 6,171,058 | B1 | 1/2001 | Stec |
| 6,273,683 | B1 | 8/2001 | Zagar et al. |
| 6,315,298 | B1 | 11/2001 | Kildea et al. |
| 6,471,484 | B1 | 10/2002 | Crall |
| 6,475,935 | B1 | 11/2002 | Ishizaki et al. |
| 6,905,312 | B2 | 6/2005 | Bourgy et al. |
| 7,121,800 | B2 | 10/2006 | Beattie |
| 7,168,914 | B2 * | 1/2007 | Shiozaki et al. ..... 415/115 |

* cited by examiner

*Primary Examiner* — Edward Look
*Assistant Examiner* — Dwayne J White
(74) *Attorney, Agent, or Firm* — Carlson Gaskey & Olds PC

(57) ABSTRACT

A turbine blade damper-seal assembly includes a seal nested within a damper such that both the seal and damper are disposed to provide sealing between adjacent blade platforms. The seal traverses the seal slot in the damper and seals the gap between adjacent blade platforms for the full axial length of the neck cavity between adjacent blades. The damper is located in an aft most position and includes features to facilitate vibration-dampening performance. The damper also includes features that cause entrapment between blades and therefore avoids the conventionally required protrusions on the blade to retain it in the assembled position.

31 Claims, 6 Drawing Sheets

TURBINE BLADE NESTED SEAL AND DAMPER ASSEMBLY

BACKGROUND OF THE INVENTION

This application relates generally to a turbine blade damper-seal assembly.

Conventional gas turbine engines include a turbine assembly that has a plurality of turbine blades attached about a circumference of a turbine rotor. Each of the turbine blades is spaced a distance apart from adjacent turbine blades to accommodate movement and expansion during operation. Each blade includes a root that attaches to the rotor, a platform, and an airfoil that extends radially outwardly from the platform.

Hot gases flowing over the platform are prevented from leaking between adjacent turbine blades by a seal as components below the platform are generally not designed to operate for extended durations at the elevated temperatures of the hot gases. The seal is typically a metal sheet nested between adjacent turbine blades on an inner surface of the platform. The seal is flexible so as to conform to the inner surface of the platform and prevent the intrusion of hot gases below the platform of the turbine blade. Typically, the seal is disposed against a radially outboard inner surface of the platform of the turbine blade and is pressurized by relatively cooler high pressure air. Significant usage of the cooler high pressure air will be detrimental to engine performance and should be minimized.

In addition to the seal it is common practice to include a damper between adjacent turbine blades to dissipate potentially damaging vibrations. The damper is sized to provide sufficient mass and rigidity to dissipate vibration from the turbine blade.

Accordingly, it is desirable to provide a seal and damper assembly which achieves an effective seal of gaps between adjacent high pressure turbine blade platforms, and dampening of high pressure turbine blade platforms when fully assembled in a turbine disk.

SUMMARY OF THE INVENTION

This invention is a damper-seal assembly for a turbine blade that includes a seal nested within a damper such that both the seal and damper are disposed to provide sealing at an aft section of the blade platforms.

The damper provides dampening, and unlike traditional interplatform turbine blade dampers, also provides sealing. The damper also includes features that cause entrapment between blades and therefore avoids the conventionally required protrusions on the blade for retention in the assembled position. Minimization or elimination of such blade protrusions facilitates manufacture of a less complicated and stronger, yet less expensive blade.

The damper-seal assembly is centrifugally swung outward to seat against the blade under-platform surfaces when the engine begins to spin such that both the seal and damper remain positively seated throughout engine operation. The seal contacts the inner surfaces of the blade platforms and prevents hot core gas from entering the cavity between adjacent blades while minimizing the leakage of performance penalizing high pressure air into the hot flow path. The seal traverses the seal slot in the damper and seals the gap between adjacent blade platforms for the full axial length of the neck cavity between adjacent blades. The seal also includes a lengthwise seam that aligns with the intersection of the under-platform surfaces of the two adjacent blades along the circumferential gap between the blade platforms.

The damper provides a stiff bridge between adjacent blade platforms to cause damping. The damper is located in an axially aft most position of the blade platform and includes rear surfaces that form a seal between the adjacent surfaces of the blades to facilitate vibration-dampening performance. A lengthwise seal slot receives the seal when assembled, while an aft leg defines the rear surfaces that provide sealing between adjacent blade platform rear gussets that is conventionally either not sealed or requires a separate sheet-metal seal.

Accordingly, the damper-seal assembly of this invention achieves an effective seal of gaps between adjacent blade platforms, and dampening of blade platforms when fully assembled in a turbine disk

BRIEF DESCRIPTION OF THE DRAWINGS

The various features and advantages of this invention will become apparent to those skilled in the art from the following detailed description of the currently disclosed embodiment. The drawings that accompany the detailed description can be briefly described as follows.

DETAILED DESCRIPTION OF THE DISCLOSED EMBODIMENT

Figure 1:
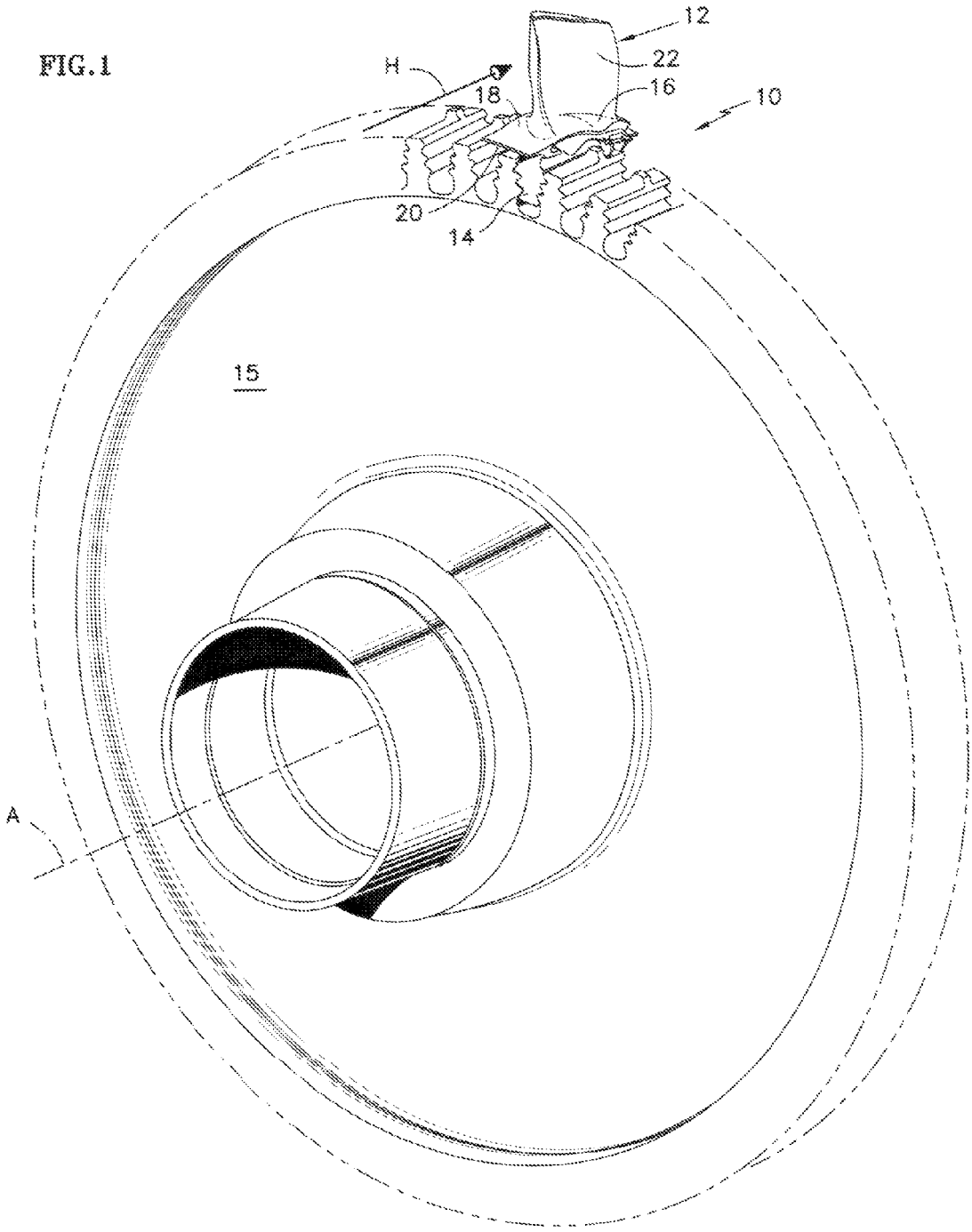
FIG. 1 is a front perspective view of a turbine rotor disk assembly illustrating a single turbine blade mounted thereto.

Referring to FIG. 1, a turbine rotor assembly 10 includes a plurality of adjacent turbine blades 12 (one shown) mounted to a turbine rotor disk 15 about an engine axis A. Each of the turbine blades 12 includes a root 14 that is fit into a corresponding slot of the turbine rotor disk 15. Radially outward of the root 14 is a platform 16. The platform 16 defines an outer platform surface 18 and an inner platform surface 20. The inner surface 20 is disposed radially inward of the outer surface 18. An airfoil 22 extends outward from the platform 16.

Figure 2:
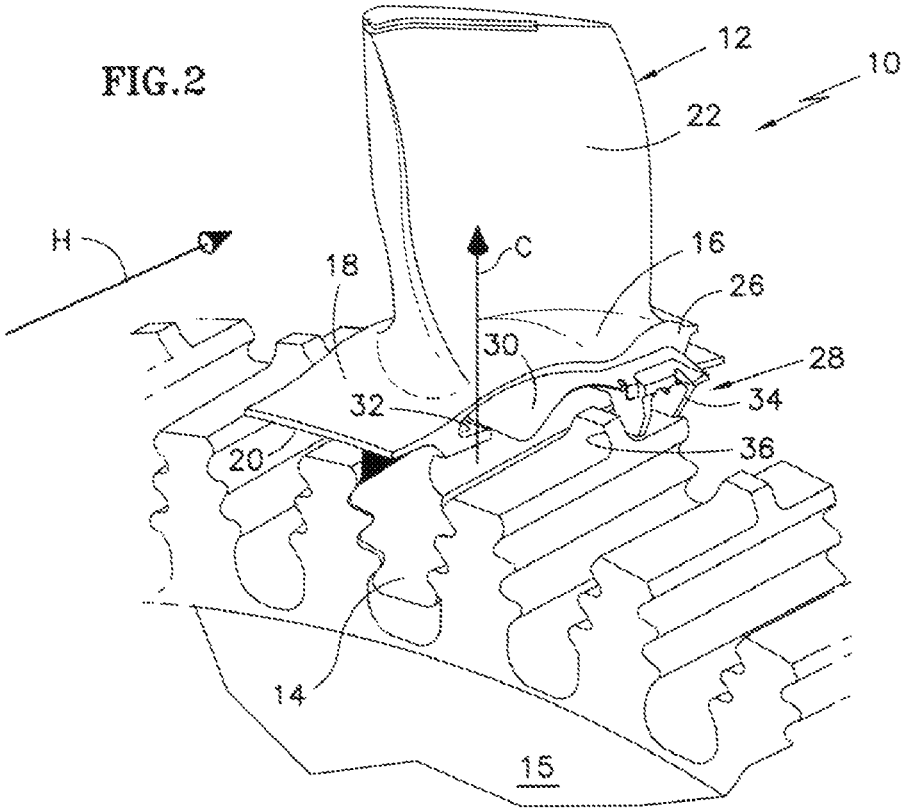
FIG. 2 is an expanded front perspective view of the turbine blade mounted to the turbine disk.
Figure 3:
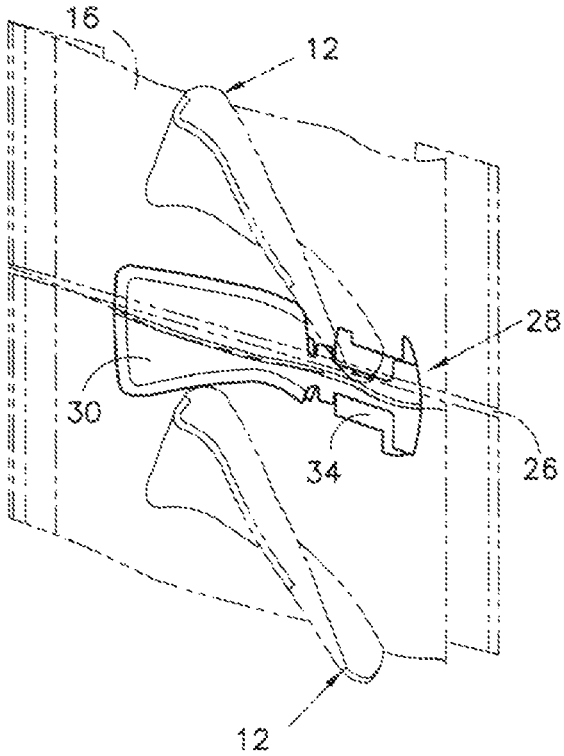
FIG. 3 is a top partial phantom view illustrating a damper-seal assembly mounted between two turbine blades.
Figure 4:
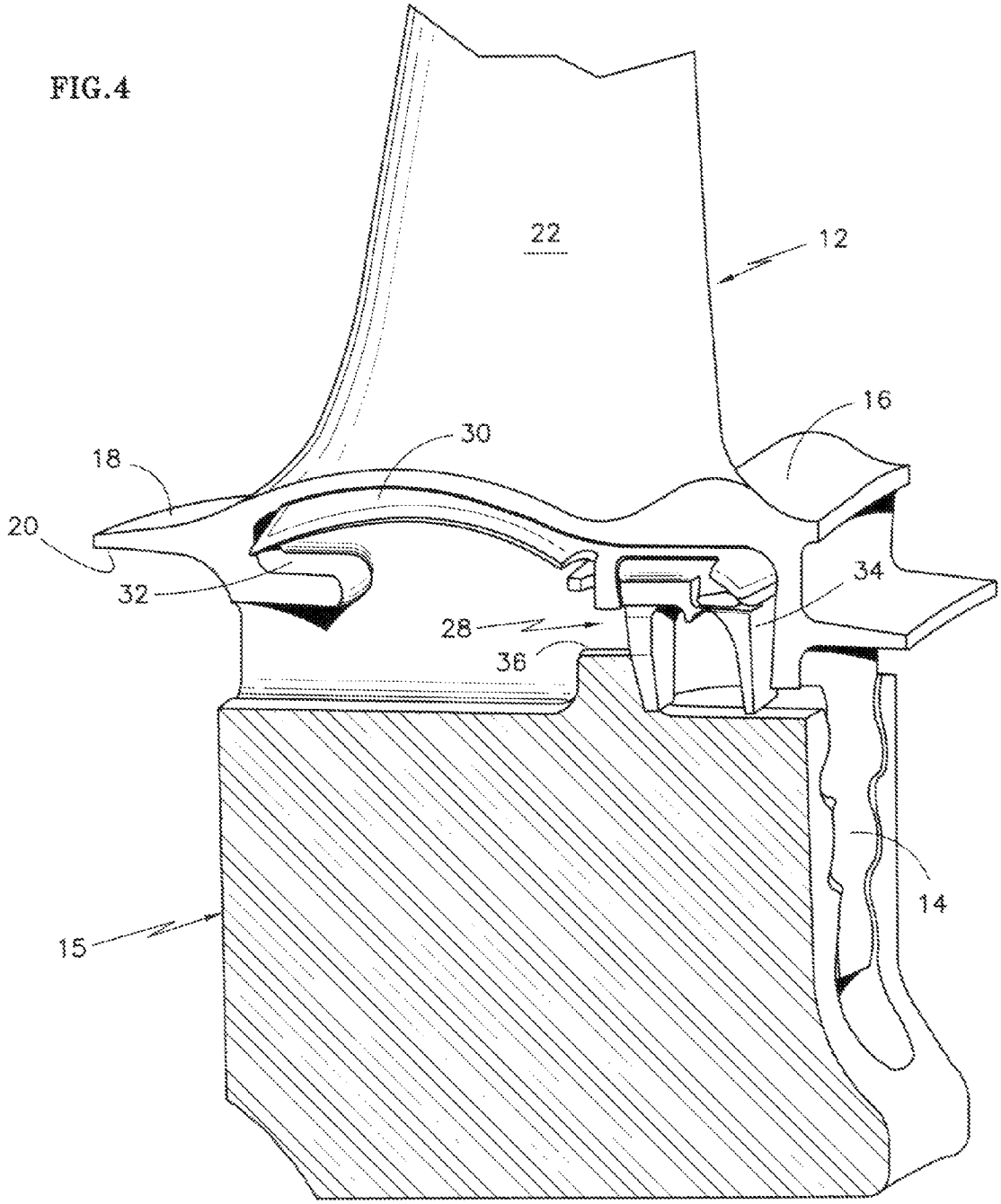
FIG. 4 is a side sectional view through a turbine blade and disk illustrating the damper-seal assembly therein.

Referring to FIG. 2, hot gas H flows around the airfoil 22 and over the outer platform surface 18 while relatively cooler high pressure air (C) pressurizes the cavity under the platform 16. A gap 26 extends axially between adjacent turbine blades 12 (FIG. 3). The gap 26 prevents contact and allows for thermal growth between adjacent turbine blades 12. A damper-seal assembly 28 includes a seal 30 and a damper 34 to prevent hot gases from penetrating the gap 26 and the underside of the platform 16 and minimize the leakage of cooler high pressure air into the hot gas H flow path. The seal 30 is positioned within a cavity 32 formed between adjacent turbine blades 12 (FIG. 4). The seal 30 abuts the inner surface 20 of the platform 16 and bridges the gap 26 to block the flow of hot gases between blades 12.

The damper-seal assembly 28 is assembled within the cavity 32 of the turbine blade 12 such that both the damper 34 and the seal 30 are adjacent the inner surface 20. The damper 34 provides dampening, and unlike traditional interplatform turbine blade dampers, also provides sealing.

The rotor disk 15 includes a radial lug 36 on its outer diameter which further restricts the damper 34 from becoming dislodged to thereby at least partially align and position the damper-seal assembly 28. The damper 34 engages the radial lug 36 to further cause entrapment between blades and therefore avoid the conventionally required protrusions on the blade to retain it in the assembled position. Minimization or elimination of such blade protrusions facilitates manufacture of a less complicated, stronger and less expensive blade.

The damper-seal assembly 28 is centrifugally swung out to seat against the blade under-platform surfaces when the engine spins such that both the seal 30 and damper 34 remain seated throughout engine operation. The seal 30 contacts the inner surfaces of the blade platforms and prevents hot gas flow path air H from penetrating through the cavity between adjacent blade platforms and minimize the leakage of cooler high pressure air into the hot gas flow path. When the engine rpm increases, the centrifugal force on the seal increases against the inner surfaces of the platform to thus seal and bridge the gap between two adjacent blade platforms. One main function of the damper is to provide a stiff bridge between adjacent blade platforms to cause damping.

Figure 5A:
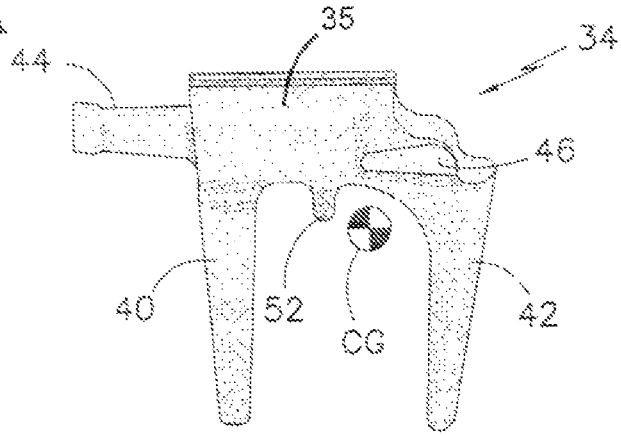
FIG. 5A is a side perspective view of a damper.
Figure 5B:
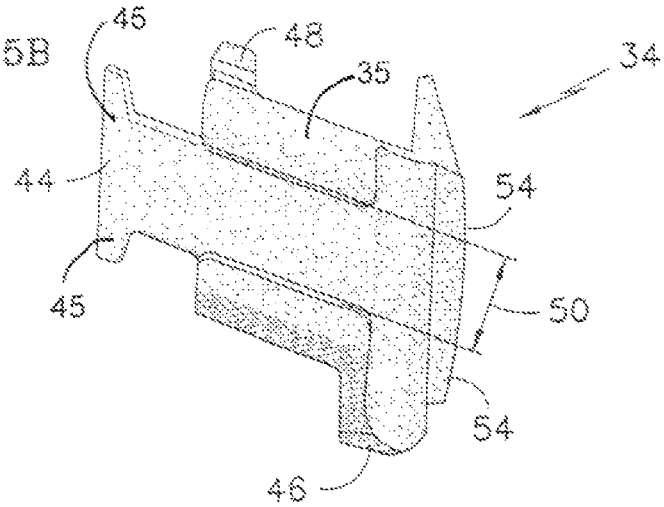
FIG. 5B is a top perspective view of the damper of FIG. 5A.

Referring to FIG. 5A, the damper 34 generally includes a damper body 35, a front leg 40, an aft leg 42, a forward protrusion 44, which extends from the damper body 35, a concave side positioning tab 46, a convex side positioning tab 48, a lengthwise seal slot 50 (FIG. 5B), and a crosswise underbody stiffener rib 52.

The damper 34 is fabricated from a material that minimizes plastic deformation under the thermal and centrifugal loads produced during engine operation. Further, the material utilized for the damper 34 is selected to provide desired vibration dampening properties in addition to the thermal and high strength capacity. The damper 34 may be constructed of a cast nickel alloy material for example.

The damper 34 is located in an aft most position and includes features to facilitate vibration-dampening performance. The lengthwise seal slot 50 (FIG. 5B) receives the seal 30 when assembled (FIG. 6), while the aft leg 42 defines aft seal surfaces 54 that provide sealing between adjacent blade platform rear gussets 56 (FIG. 7). That is, forward protrusion 44 extends from the damper body 35 which essentially ends at the front leg 40 such that the forward protrusion 44 essentially extends thereform in a cantilever manner (FIG. 5A). The damper forward protrusion 44 maintains the seal 30 tangential position during assembly and engine operation as the lengthwise seal slot 50 is recessed within the damper body 35 and the forward protrusion 44 extends in plane with the lengthwise seal slot 50 from the damper body 35.

The damper aft seal surfaces 54 provide sealing in an area that is typically either not sealed or requires a separate sheet-metal seal in conventional seal-dampers. The damper 34 center of gravity (CG) is slightly aft of the damper longitudinal center (FIG. 5A) to facilitate the seal between the aft seal surface 54 and the blade platform rear gussets 56 (FIG. 7), during engine operation to seal the air gap between two adjacent blades. The rear surfaces 54 of the damper 34 thereby also operate as seal surfaces.

The damper stiffener rib 52 provides increased stiffness to the damper 34. The damper stiffener rib 52 facilitates damping effectiveness of the blade platform.

Figure 6:
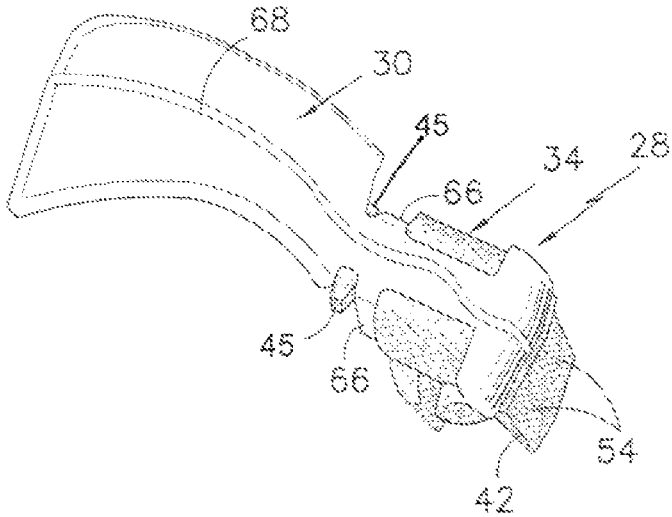
FIG. 6 is a top perspective view of the damper-seal assembly.
Figure 7:
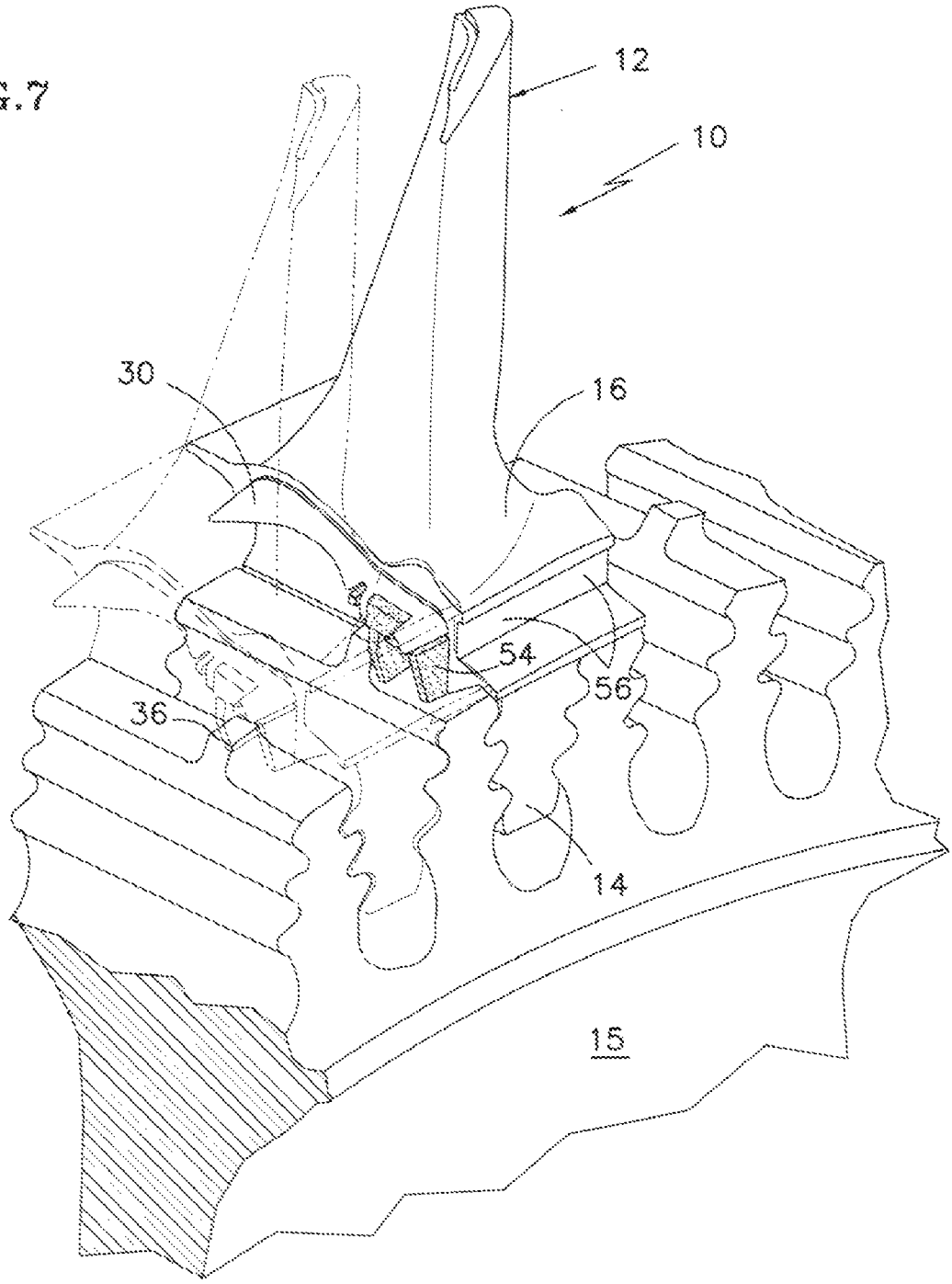
FIG. 7 is a rear perspective partial phantom view of a damper-seal assembly between two turbine blades mounted to a turbine rotor disk.
Figure 8A:
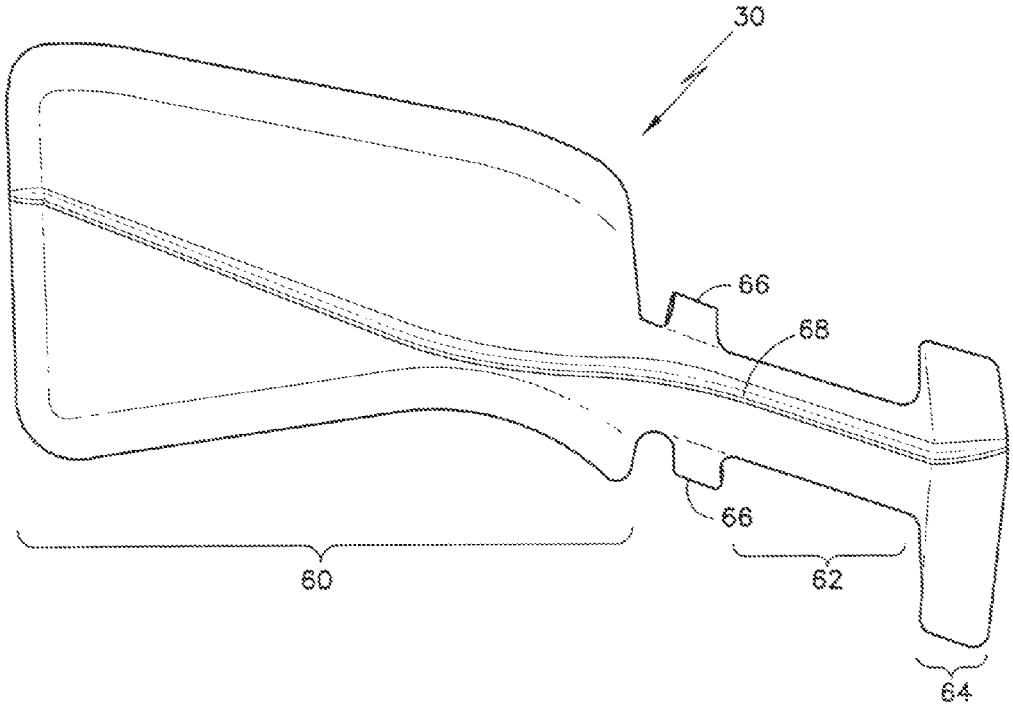
FIG. 8A is a top view of a seal.

Referring to FIG. 8A, the seal 30 generally includes a forward seal area 60, a bridge seal area 62, an aft seal area 64, and mid-section tangs 66 which position the seal 30 on the forward protrusion 44 between lateral extensions 45 which extends lateral relatively to the seal slot 50 and the damper body 35 (FIG. 6). The forward seal area 60 generally increase in lateral width as the forward seal area 60 extends longitudinally forward and away from the bridge seal area 62.

The seal 30 is manufactured of a relatively thin sheet of metal that is generally flexible to conform to the inner platform surface 20 and provide a desired seal against the intrusion of hot gases. The material utilized for the seal 30 is selected to withstand the pressures and temperatures associated with a specific application and to allow for some plastic deformation. The seal 30 plastically deforms responsive to the thermal and centrifugal loads to conform and fit the contours of the inner surface 20. The plastic deformation provides a desired seal against the intrusion of hot gases and minimizes leakage of cooler air. The seal 30 may be fabricated from 0.024 inch thick AMS5608 sheet-metal nickel alloy for example.

The seal 30 bridges the seal slot 50 in the damper 34 (FIG. 7) and seals the gap between adjacent blade platforms for the full axial length of the neck cavity between adjacent blades. The fit within the seal slot 50 positions the seal 30 relative to the damper 34 and thereby relative to the gap 26 between adjacent turbine blades 12. The seal 30 also includes a lengthwise seam 68 that aligns with the intersection of the under-platform surfaces of the two adjacent blades 12 along the middle of the circumferential gap between the blade platforms. The seam 68 may be completely or partially linear or non-linear and the actual shape depends on the gap shape.

Figure 8B:
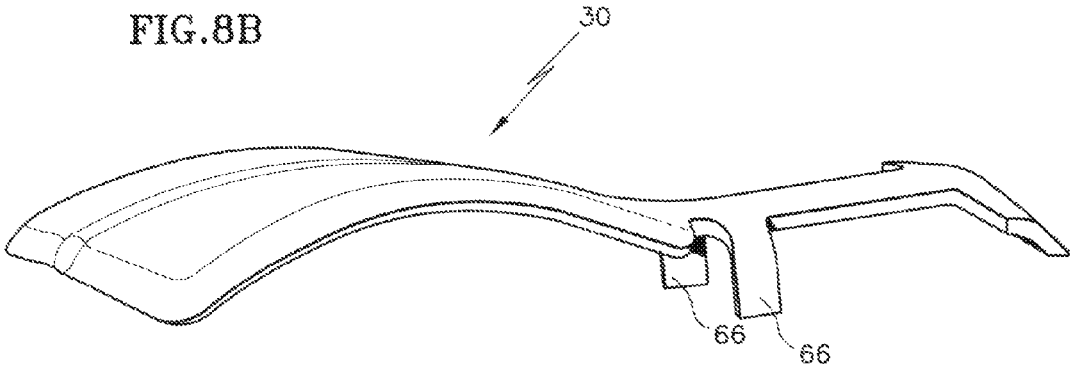
FIG. 8B is a perspective frontal view of the seal illustrated in FIG. 8A.

The seal 30 traverses the damper 34 to provide sealing forward and aft of the damper-to-blade under-platform contact surfaces. The seal 30 mid-section formed tangs 66—in the disclosed embodiment a 90 degree inward bend (FIG. 8B)—near the midsection captures the damper 34 in a centered position during engine assembly and operation.

The seal 30 contacts the inner surfaces of the blade platforms 16 and prevents gas path air from entering the cavity between adjacent blades while minimizing leakage of high pressure cooler air in the hot flow path. When the engine rpm increases the centrifugal force of the seal increases and pushes against the inner surfaces of the platform thus creating a seal that bridges the gap between two adjacent blades. The damper operates as a seal but primarily functions to provide a stiff bridge between adjacent blade platforms and cause damping. The damper aft seal surfaces 54 is designed such that these surfaces form a seal between the adjacent forward surfaces of the blade platform rear gussets.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A gas turbine engine rotor assembly comprising:

a multitude of blades spaced apart from each other for rotation about an axis of rotation, each of said plurality of turbine blades having a blade platform which defines an inner platform surface and an outer platform surface;

a damper having a lengthwise seal slot and an aft seal surface adjacent said inner platform surface, said damper includes a damper body with a forward leg which extends from said damper body transverse to said lengthwise seal slot and an aft leg which extends from said damper body transverse to said lengthwise seal slot and generally parallel to said forward leg, said aft leg having an aft seal surface; and a seal nested with said lengthwise seal slot and disposed adjacent said inner platform surface.

2. The assembly as recited in claim 1, wherein said seal comprises tangs that fit onto said damper.

3. The assembly as recited in claim 2, wherein said damper comprises alignment features for aligning said damper relative to each of said plurality of turbine blades.

4. The assembly as recited in claim 1, wherein said damper includes a center of gravity aft of a longitudinal center and between said forward leg and said aft leg.

5. The assembly as recited in claim 1, wherein said damper includes a crosswise underbody stiffener rib.

6. The assembly as recited in claim 1, wherein said seal includes a lengthwise seam that aligns with a circumferential gap between two blade platforms at the intersection of two adjacent blades.

7. The seal as recited in claim 1, further comprising a damper forward protrusion that extends said lengthwise seal slot, said damper forward protrusion includes lateral extensions which extend laterally relatively to said lengthwise seal slot.

8. The seal as recited in claim 7, wherein said seal includes mid-section tangs engageable with said lateral extension and said damper body.

9. A gas turbine engine rotor assembly comprising:

a multitude of blades spaced apart from each other for rotation about an axis of rotation, each of said plurality of turbine blades having a blade platform which defines an inner platform surface, an outer platform surface, a forward portion and an aft portion, said inner and outer platform surfaces extend therebetween;

a damper having a lengthwise seal slot and an aft seal surface adjacent said inner platform surface, said damper disposed adjacent said aft portion; and a seal nested with said lengthwise seal slot and disposed adjacent said inner platform surface.

10. The assembly as recited in claim 9, wherein said damper includes an aft leg which defines a rear surface adjacent said aft portion.

11. The assembly as recited in claim 9, wherein said damper includes an aft leg which defines a rear surface adjacent said aft portion, said aft surface seals between adjacent blade platform rear gussets.

12. A gas turbine engine rotor assembly comprising:

a multitude of blades spaced apart from each other for rotation about an axis of rotation, each of said plurality of turbine blades having a blade platform which defines an inner platform surface and an outer platform surface;

a damper having a lengthwise seal slot and an aft seal surface adjacent said inner platform surface;

a seal nested with said lengthwise seal slot and disposed adjacent said inner platform surface; and a rotor disk having a radial lug on an outer diameter which restricts axial movement of said damper.

13. A damper and seal assembly for a gas turbine engine rotor blade comprising:

a damper body defining a lengthwise seal slot, said damper body having an aft seal surface;

a damper forward protrusion that extends said lengthwise seal slot, said damper forward protrusion includes lateral extensions which extend laterally relatively to said lengthwise seal slot; and a seal nested within said lengthwise seal slot, said seal includes mid-section tangs engageable with said lateral extension and said damper body.

14. The assembly as recited in claim 13 wherein said damper defines a front leg and an aft leg, said aft leg defines said aft seal surface.

15. The assembly as recited in claim 14, further comprising a crosswise underbody stiffener rib between said front leg and said aft leg.

16. The assembly as recited in claim 13, wherein said damper includes a concave side positioning tab and a convex side positioning tab.

17. The assembly as recited in claim 13, wherein said seal includes a lengthwise seam.

18. The assembly as recited in claim 17, wherein said lengthwise seam is non-linear.

19. The assembly as recited in claim l3, wherein said damper has a center of gravity aft of a longitudinal center.

20. The assembly as recited in claim 13 wherein said lengthwise seal slot is recessed within said damper body, said forward protrusion extends in plane with said lengthwise seal slot from said damper body in a cantilever manner.

21. A damper comprising:

a damper body which defines a lengthwise seal slot;

a forward leg which extends from said damper body transverse to said lengthwise seal slot; and an aft leg which extends from said damper body transverse to said lengthwise seal slot and generally parallel to said forward leg, said aft leg having an aft seal surface.

22. The damper as recited in claim 21, wherein said damper has a center of gravity aft of a longitudinal center and between said forward leg and said aft leg.

23. The damper as recited in claim 21, further comprising a crosswise underbody stiffener rib between said front leg and said aft leg.

24. The damper as recited in claim 21, wherein said forward protrusion extends from said damper body in a cantilever manner.

25. The assembly as recited in claim 21 wherein said lengthwise seal slot is recessed within said damper body, said forward protrusion extends in plane with said lengthwise seal slot from said damper body in a cantilever manner.

26. The damper as recited in claim 21, further comprising a damper forward protrusion that extends said lengthwise seal slot, said damper forward protrusion includes lateral extensions which extend laterally relatively to said lengthwise seal slot.

27. A seal comprising:

a seal member having a top surface with a lengthwise seam and a forward seal area with a forward width, a bridge seal area aft of the forward seal area, said bridge seal area having a bridge width less than the first width and an aft seal area having an aft width, said aft width greater than said bridge width.

28. The seal as recited in claim 27, wherein said bridge seal area define mid-section tangs transverse to said bridge seal area.

29. The seal as recited in claim 27, wherein said forward seal area increases in lateral width as said forward seal area extends longitudinally away from said bridge seal area.

30. The seal as recited in claim 27, wherein said lengthwise seam is a raised area from said top surface.

31. The seal as recited in claim 27, wherein said lengthwise seam aligns with a circumferential gap between two blade platforms at the intersection of two adjacent blades.

* * * * *